United States Patent [19]

Krivec et al.

[11] Patent Number: 4,594,047

[45] Date of Patent: Jun. 10, 1986

[54] CONVEYING MEANS FOR REMOVING A HEAP OF DEBRIS

[75] Inventors: Eduard Krivec; Helmut Gradenegger, both of Zeltweg, Austria

[73] Assignee: Voest-Alpine Aktiengesellschaft, Vienna, Austria

[21] Appl. No.: 605,284

[22] Filed: Apr. 30, 1984

[30] Foreign Application Priority Data

May 5, 1983 [AT] Austria ..... 1662/83

[51] Int. Cl.[4] ..... B65G 47/16

[52] U.S. Cl. ..... 414/565; 414/697

[58] Field of Search ..... 414/565–567, 414/706, 707, 710, 715, 697; 198/307, 509, 510, 307.1, 510.1

[56] References Cited

U.S. PATENT DOCUMENTS

| | | | |
|---|---|---|---|
| 1,293,447 | 2/1919 | Huhn | 414/565 |
| 2,208,205 | 7/1940 | Biedess | 414/565 |
| 2,775,356 | 12/1956 | Lessmann | 414/715 |
| 3,127,038 | 3/1964 | Allard | 414/565 |
| 3,966,066 | 6/1976 | Schexnayder | 414/706 |
| 4,088,236 | 5/1978 | Moore | 414/565 |
| 4,486,049 | 12/1984 | Lubrich et al. | 414/565 X |

FOREIGN PATENT DOCUMENTS

| | | | |
|---|---|---|---|
| 1484756 | 4/1969 | Fed. Rep. of Germany | 414/715 |

*Primary Examiner*—Joseph E. Valenza

*Assistant Examiner*—David A. Bucci

*Attorney, Agent, or Firm*—Cushman, Darby & Cushman

[57] ABSTRACT

Apparatus for removing and conveying a heap of debris includes a continuous conveyor supported by a frame and having a charging end and a discharging end; two cantilever arms having outer free ends and having inner ends pivotally supported on the frame for swinging movement about a horizontal transverse arm pivot axis between lowered and raised positions; a transverse crossbeam extending between the outer free ends of the arms and pivoted thereto for swinging movement about a horizontal beam axis; a loading shovel having an open front for shoveling up debris and a back wall which has an upper edge, the shovel being pivoted to the crossbeam for swinging movement about a horizontal shovel pivot axis which is located near the upper edge of the back wall, the arrangement of shovel, crossbeam and arms being such that in the lowered position of the arms, the shovel pivot axis is above the beam pivot axis and the shovel is swingable to a lowered, loading position in engagement with the beam for shoveling in debris and such that in the raised position of the arms the shovel is swingable to a raised position in which the upper edge of the back wall forms a discharge edge for discharging shoveled material to the charging end of the conveyor; and drive devices for swinging the beam about the beam pivot axis, for swinging the shovel about the shovel and for swinging the arms about the arm pivot axis.

5 Claims, 2 Drawing Figures

CONVEYING MEANS FOR REMOVING A HEAP OF DEBRIS

Figure 1:
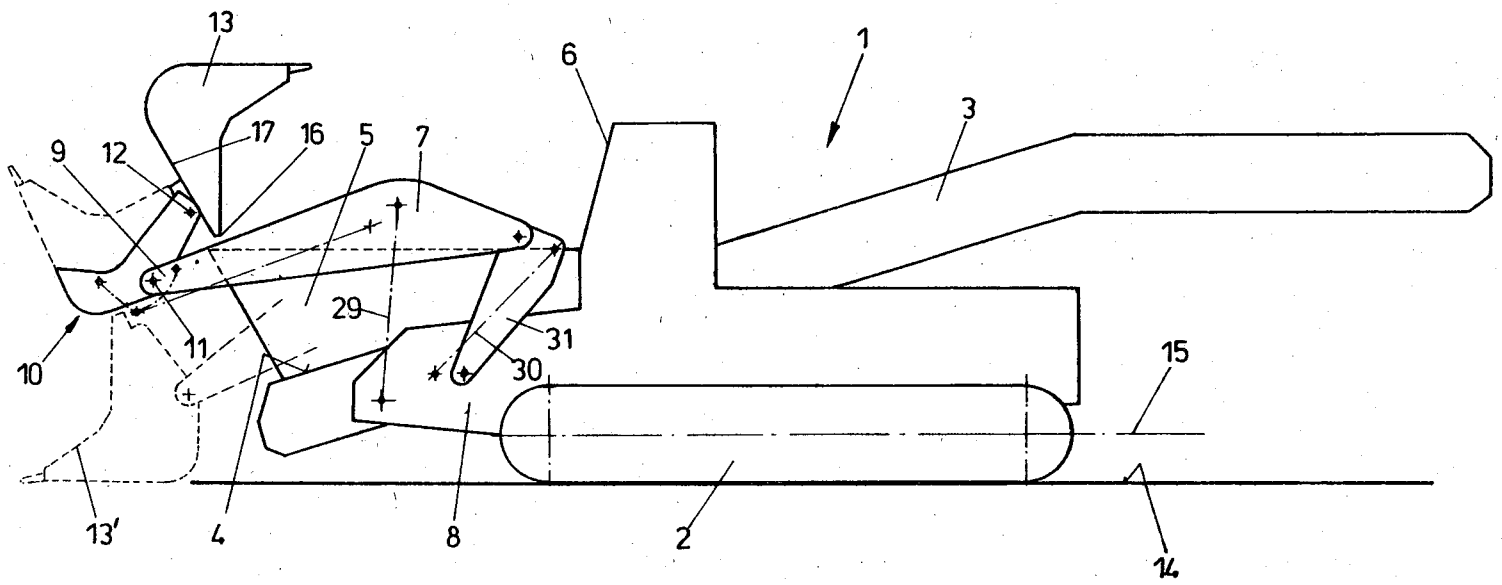

The invention refers to a conveying means for removing a heap of debris and comprising a continuous conveyor, particularly designed as a band conveyor or a chain conveyor, in which the end of the conveying means facing the heap of debris has two cantilever arms and a loading shovel is arranged between the cantilever arms so as to be swivelled around an essentially horizontal axis crossing or intersecting the longitudinal axis of the conveying means, and in which a charging chute is arranged above the continuous conveyor and within the area of that end of the conveying means which faces the heap of debris, noting that for the purpose of discharging the heap of debris into the charging chute, the loading shovel is arranged so as to be swivelled around an essentially horizontal axis crossing or intersecting the longitudinal axis of the conveying means and the swivelling drive of the cantilever arms covers a pivoting angle in which the upper edge of the back wall of the loading shovel is located above the receiving opening of the charging chute and forms the discharge edge for the material to be conveyed. Such a conveying means is known from U.S. Pat. No. 1,293,447. In this known construction, the loading shovel is pivoted immediately between two cantilever arms. The pivotal point must be arranged in such a way that the loading shovel can be shifted forwards when picking up the heap of debris. This pivotal point must thus be arranged on the shovel at a comparatively low level. When emptying the loading shovel over the upper edge of the back wall, the loading shovel must be tilted around the same pivoting axis, so that the charged material is only dumped and not thrown out, and the shovel cannot be emptied completely, in particular with wet charged material.

It is the object of the invention to make it possible for the loading shovel of a conveying means of the initially described type to effect a throwing movement when discharging the bulk material via the upper edge of the back wall of the loading shovel. For solving this task, the invention essentially consists in that the cantilever arms comprise, at their free ends, a crossbeam connecting both cantilever arms, the loading shovel being pivotably supported on said crossbeam so as to be swivelled around an axis crossing or intersecting the longitudinal axis of the conveying means and located in the area of the upper edge of the back wall of the loading shovel, and the crossbeam being contacted by the loading shovel in its pick-up position on the surface or floor, respectively, to be cleared, and in that the loading shovel has a swivelling drive. On account of the loading shovel being pivotally supported so as to be swivelled around an axis located in the area of the upper edge of the back wall of the loading shovel and on account of the loading shovel being driven by means of a swivelling drive for effecting a swivelling movement around this axis, a throwing effect is achieved when emptying the loading shovel via its back wall, the result of this throwing effect being that the charged material is thrown out of the loading shovel. In this manner, it is made sure that the loading shovel is also completely emptied in the case of wet charged material. If during picking up of the bulk material the advancing force effected by the cantilever arms acts on the pivotal axis located at a high level, this results in tilting of the loading shovel. Such tilting is, however, avoided, because the loading shovel in its pick-up position contacts the surface or floor, respectively, to be cleared and is thus maintained in the correct pick-up position.

According to a preferred embodiment of the invention, the crossbeam is pivotally linked to the free ends of the cantilever arms, noting that there is conveniently provided a swivelling drive for the crossbeam. In pick-up position, the loading shovel contacting the crossbeam forms a unit with the crossbeam, and if the crossbeam is pivotally linked to the free ends of the cantilever arms, the loading shovel remains in the correct pick-up position when picking up the bulk material, because the advancing force exerted by the cantilever arms acts on a lower level. According to the invention, when the loading shovel is in lowered position, the pivotal axis linking the loading shovel to the crossbeam is located at a higher level than the pivotal axis of the crossbeam. If a swivelling drive for the crossbeam is provided, the loading shovel can be maintained in receiving position during lifting of the loading shovel by means of the crossbeam. Such a swivelling drive can, according to the invention, be realized in a simple manner if the crossbeam has, outside of its swivelling axis, a point of engagement for a hydraulic cylinder-piston aggregate capable of being connected with the cantilever arms. The crossbeam can, in this case, be immediately connected with the hydraulic cylinder-piston aggregate. In case, on account of the geometry of the cantilever arms, a position becomes possible in which the longitudinal axis of the hydraulic cylinder-piston aggregate driving the crossbeam intersects the pivotal axis of the crossbeam, it is necessary to interposition a rocker arm or a guide rod, respectively, to make sure that the force for swivelling the crossbeam can be transmitted in any position.

According to the invention, the swivelling drive of the loading shovel is preferably supported on the crossbeam. This swivelling drive is conveniently designed as a hydraulic cylinder-piston aggregate acting on the crossbeam and on the loading shovel. This provides for a favorable construction, and the loading shovel is tilted relative to the crossbeam already assuming a swivelled position. According to the invention, the pivotal axis for linking the loading shovel to the crossbeam is arranged in parallel relation to the pivotal axis of the crossbeam, so that the lifting movement and the extending movement of the loading shovel take place in the same direction.

According to the invention, the crossbeam conveniently has the shape of a plate member and is preferably designed with side walls at least partially embracing the loading shovel.

In the following, the invention is further explained with reference to an embodiment shown in the drawing. In the drawing, FIG. 1 is a schematic side elevation of a conveying means according to the invention and FIG. 2 is a view similar to that of FIG. 1, but showing the loading shovel in an enlarged scale.

In FIG. 1, there is designated by 1 the conveying means having a crawler chassis 2. In the middle between the crawler chains of the crawler chassis 2, there is arranged a continuous conveyor 3, and a charging chute 5 is arranged above the front charging end 4 of this continuous conveyor. In front of the driver's cabin 6, cantilever arms 7 are pivotally supported on the frame 8 of the conveying means 1 so as to be swivelled in height direction. The cantilever arms 7 carry a crossbeam 10 pivotally supported between the free ends 9 of the cantilever arms. The pivotal axis of the crossbeam 10 is designated by 11. A loading shovel 13 is pivotally linked to the crossbeam 10 so as to be swivelled around an axis 12 extending in parallel relation to the pivotal axis 11. The axes 11 and 12 extend in a substantially horizontal direction and thus in parallel relation to the plane of the floor 14 and cross the longitudinal axis 15 of the conveying means 1. In FIG. 1, the lowered position 13' of the loading shovel is shown in dashed lines. In the position of the loading shovel 13 shown in full lines, the loading shovel is raised relative to the floor plane 14 and swivelled around the axis 12 in a position in which the upper edge 16 of the back wall 17 of the loading shovel 13 is located above the charging chute 5, so that the material picked up can be transferred to the charging chute 5.

Figure 2:
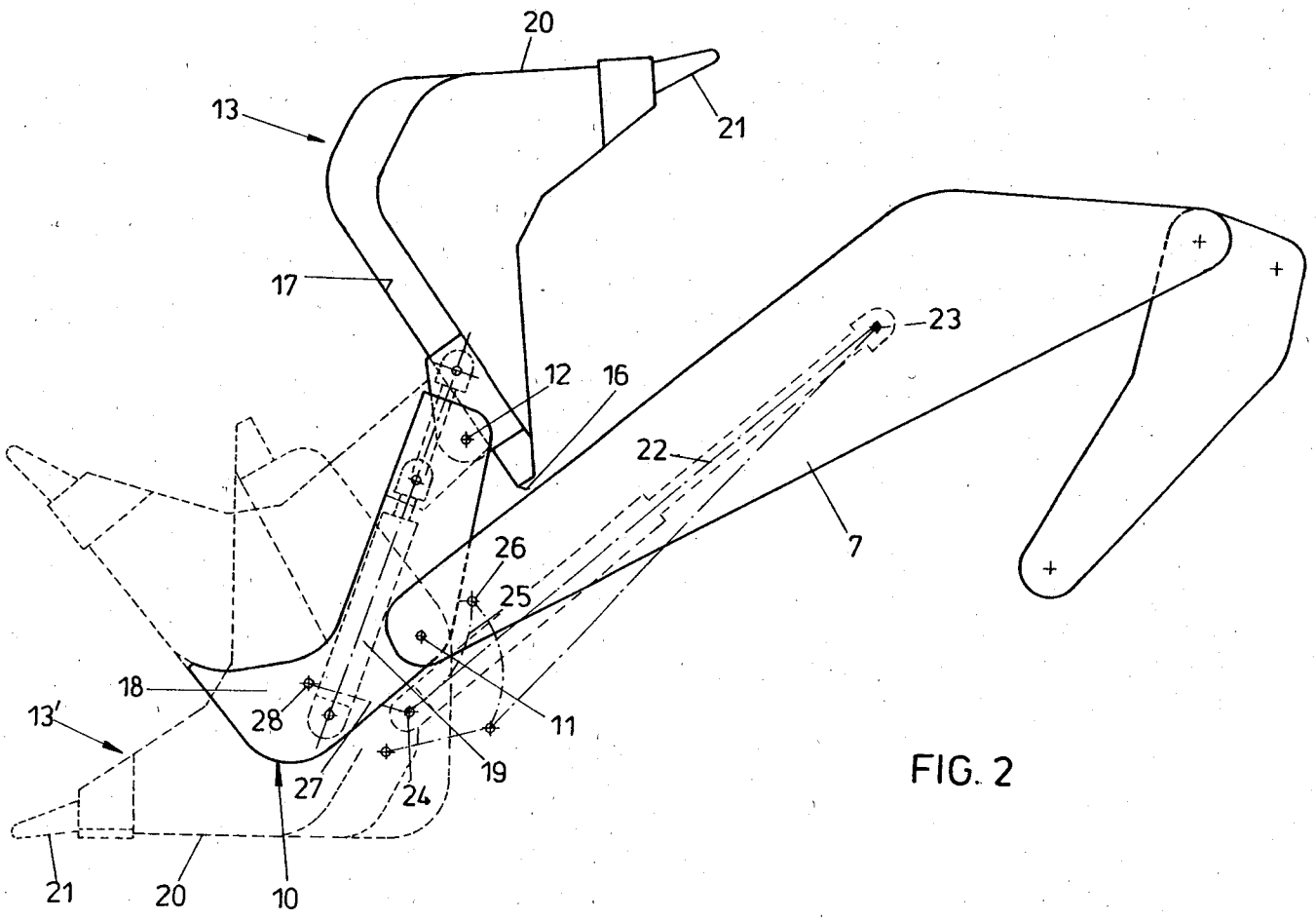

In the representation according to FIG. 2, the kinematics of swivelling the loading shovel 13 is clearly shown. The crossbeam 10 is again linked to the cantilever arms 7 so as to be swivelled around the axis 11. The crossbeam 10 has side wall members18 which embrace the loading shovel 13. The pivotal point for the axis 12 is provided on the side wall members 18, and a hydraulic cylinder-piston aggregate 19 is arranged between the side wall members 18 and the loading shovel 13, said cylinder-piston aggregate allowing the loading shovel 13 to be swivelled relative to the crossbeam 10. The swivelling movement of the loading shovel 13 can, starting from a position in which the front wall 20 of the loading shovel 13 rests on the floor 14, first be effected by lifting the crossbeam 10 and simultaneously swivelling same around the axis 11 relative to the cantilever arms 7. Starting from such a swivelled position, in which it must be sure that the hydraulic cylinder-piston aggregate 19 does not intersect the pivotal axis 12 of the loading shovel on the crossbeam 10, the loading shovel 13 can, by expanding the hydraulic cylinder-piston aggregate 19, be further swivelled into a position in which the upper edge 16 of the back wall 17 of the loading shovel 13 arrives at a position above the charging chute.

In this case, the loading arms 7 can only be swivelled in height direction; it is, however, possible to provide, if required, additional lateral pivotability around a substantially vertical axis. The width or internal dimension of the loading shovel should substantially correspond to the width of the charging chute 5 and may exceed the effective width of the continuous conveyor 3. The loading shovel 13 has teeth 21 at its front wall for facilitating penetration into the heap of debris.

In the drawing, the guide rods and the hydraulic cylinder-piston aggregates are only represented by their center lines. A cylinder-piston aggregate 22 is linked to each cantilever arm 7 at 23. The other end of this aggregate is linked at 24 to a bent rocker arm 25 having its other end linked at 26 to the cantilever arm 7. The joint 24 is linked to a point 28 of engagement of the crossbeam 10 by means of a guide rod 27. 29 is a piston-cylinder aggregate which is linked to the frame 8 and to the cantilever arms 7 and serves the purpose of lifting and lowering the cantilever arms. If required, the bearing blocks 31 to which the cantilever arms 7 are linked can be swivelled relative to the frame 8 by means of a piston-cylinder aggregate 30.

What is claimed is:

1. Apparatus for removing and conveying a heap of debris comprising: a frame; a continuous conveyor supported by the frame, the conveyor having a charging end and a discharging end; two longitudinally extending, transversely spaced-apart cantilever arms having outer free ends and having inner ends pivotally supported on said frame for swinging movement about a horizontal transverse arm pivot axis between lowered and raised positions; a transverse crossbeam extending between the outer free ends of said arms and pivoted thereto from swinging movement about a horinztonal beam axis; a loading shovel having an open front for shoveling up debris and a back wall which has an upper edge; means pivoting said shovel to said crossbeam for swinging movement about a horizontal shovel pivot axis which is located near said upper edge of said back wall, the arrangement of shovel, crossbeam and arms being such that in the lowered position of said arms, said shovel pivot axis is above said beam axis and said shovel is swingable to a lowered, loading position in engagement with said beam for shoveling in debris and such that in the raised position of said arms said shovel is swingable to a raised position in which said upper edge of said back wall forms a discharge edge for discharging shoveled material to the charging end of the conveyor; means supported on at least one of said arms and acting on said crossbeam for swinging same about said beam pivot axis; means supported on said crossbeam for swinging said shovel about said shovel pivot axis; and means for swinging said arms about said arm pivot axis.

2. Apparatus as in claim 1 wherein said means for swinging said shovel is a cylinder-piston assembly connected between said shovel and said crossbeam.

3. Apparatus as in claim 1 wherein said crossbeam has the shape of a plate.

4. Apparatus as in claim 3 wherein said plate forms side walls for said shovel.

5. Apparatus as in claim 1 wherein said means for swinging said arms includes a cylinder and piston assembly connected between at least one of said arms and said frame.

* * * * *